US012752181B2

(12) United States Patent
Barnes

(10) Patent No.: US 12,752,181 B2
(45) Date of Patent: Oct. 6, 2026

(54) BOARD GAME COMPRISING INCREASING AND MANIPULATING MAGNETIC FORCES WITH MAGNETIC PLAYING PIECES

(71) Applicant: William G. Barnes, Cardiff-by-the-Sea, CA (US)

(72) Inventor: William G. Barnes, Cardiff-by-the-Sea, CA (US)

( * ) Notice: Subject to any disclaimer, the term of this patent is extended or adjusted under 35 U.S.C. 154(b) by 327 days.

(21) Appl. No.: 18/628,444

(22) Filed: Apr. 5, 2024

(65) Prior Publication Data

US 2024/0335734 A1 Oct. 10, 2024

Related U.S. Application Data

(60) Provisional application No. 63/457,736, filed on Apr. 6, 2023.

(51) Int. Cl.
*A63F 3/00* (2006.01)

(52) U.S. Cl.
CPC ..... *A63F 3/00694* (2013.01); *A63F 3/00697* (2013.01); *A63F 2003/00738* (2013.01)

(58) Field of Classification Search
CPC ..... A63F 3/00694; A63F 3/00697; A63F 2003/00716; A63F 2003/00747; A63F 2003/00826; A63F 2003/00832; A63F 2003/00738; A63F 2003/00829; A63F 2003/00839; A63F 2003/0063
USPC ..... 273/239
See application file for complete search history.

(56) References Cited

U.S. PATENT DOCUMENTS 4,462,596 A * 7/1984 Yamamoto ..... A63F 9/12 273/239
10,967,247 B1 * 4/2021 Henning ..... A63F 3/00694
2006/0087077 A1 * 4/2006 Balanchi ..... A63F 3/0423 273/239
2016/0236075 A1 * 8/2016 Liotta ..... A63F 3/00694
2023/0338822 A1 * 10/2023 Su ..... A63F 3/00697
2025/0367538 A1 * 12/2025 Hankamer ..... A63F 3/00082

FOREIGN PATENT DOCUMENTS

WO WO-2018189569 A1 * 10/2018 ..... A63F 3/02

OTHER PUBLICATIONS

Chip Theory Games, "burncycle," 2022, https://chiptheorygames.com/blogs/buyers-guides/burncycle-buyers-guide (Year: 2022).*

* cited by examiner

*Primary Examiner* — John E Simms, Jr.
*Assistant Examiner* — Randall John Lovdahl
(74) *Attorney, Agent, or Firm* — Dogwood Patent and Trademark Law; Ashley D. Johnson

(57) ABSTRACT

The invention is generally directed to a game that manipulates magnetic forces through vertical components, the weight and ferromagnetic composition of a plurality of figurines, and surface tension between magnets and the vertical components to create a three-dimensional gaming experience. Specifically, the disclosed game comprises figurines that include one or more magnets. As the magnets are added or removed, the amount of magnetic attraction associated with a particular figurine and the overall height of the figurine is increased or decreased. Each figurine is then used to attract magnets positioned on vertical pillars throughout the game board. The game further includes the use of cards, dice, and other challenging elements to increase player enjoyment.

17 Claims, 13 Drawing Sheets

BOARD GAME COMPRISING INCREASING AND MANIPULATING MAGNETIC FORCES WITH MAGNETIC PLAYING PIECES

CROSS-REFERENCE TO RELATED APPLICATIONS

This application claims priority to U.S. Provisional Patent Application No. 63/457,736, filed Apr. 6, 2023, the entire content of which is incorporated by reference herein.

FIELD OF THE INVENTION

The presently disclosed subject matter is directed to a board game comprising magnetic playing pieces that are used to increase and manipulate magnetic forces across a three-dimensional board. Specifically, the game utilizes magnetic figurines that grow in magnetic B Field strength by acquiring magnets from pillars of ascending heights.

BACKGROUND OF THE INVENTION

Tabletop games come in a variety of types and sizes and are frequently enjoyed by players around the world. In conventional board games, playing pieces are traditionally moved by hand around a two-dimensional board, with no actual physical interaction between the individual playing pieces and game components other than what is imagined through the rules and gameplay. As a result, players lack the challenge of a game that offers actual physical interactions between figurines and the components of the game in a three-dimensional space. In response, games that include a magnetic element provide unique playing experiences for players, attributed at least in part to the unique attractive properties of magnets that can be taken advantage of. It is well known that magnets include north and south poles. Opposite poles create attractive forces that are dependent on the strength of the magnetic B Field and the distance of separation between the poles. Similarly, two of the same magnetic poles create repulsive forces that are also dependent on the strength of the magnetic B Field and the distance of separation between the poles. Accordingly, games that include the use of such attractive and repulsive magnetic forces create a unique and enjoyable playing experience. Furthermore, the traditional aspect of gameplay involving the movements of pieces with energy conferred by the players can be expanded in novel ways by using magnetic fields that impact gameplay in the vertical dimension. It would therefore be beneficial to provide a unique board game that challenges the skills of a player or players by using the attractive properties of magnetic playing pieces to acquire game components from ascending heights.

SUMMARY OF THE INVENTION

The presently disclosed subject matter is directed to a board game comprising a game board defined by a top surface upon which the game is played and a grid comprising an array of spaces. The game also includes a plurality of pillars positioned on the top surface of the game board, each pillar comprising a predetermined height and a magnet releasably positioned on a top surface of the pillar, wherein one pillar is configured as the tallest pillar. The game further includes a plurality of figurines controlled by players with each figurine comprising a magnet permanently or semi-permanently attached to a top surface of the figurine, wherein each figurine is configured to move about the grid.

Each figurine has a magnetic force provided by one or more figurine magnets, the strength of the magnetic force depending on the grade, size, and shape of the magnets, as well as the number of figurine magnets associated with that particular figurine. The figurine will exert an attractive force on any ferromagnet material (i.e. a figurine made from a material such as iron) that is brought into close proximity. If two magnets are brought into close proximity the force can be either attractive or repulsive depending on the orientation of their poles. "Magnetic attraction" refers to the force exerted by a magnet or the magnetic fields that pulls ferromagnetic materials when brought into close proximity. All magnets have two poles, a north and a south pole. If opposite poles of two magnets are brought into close proximity (e.g. north-south) they will exert an attractive force on one another. Conversely, if two alike poles are brought into close proximity (e.g. north-north or south-south) the magnets will exert a repulsive force on one another. The attraction and repulsion is referred to as magnetism.

If the magnetic attraction of each figurine is sufficiently great, a pillar magnet can move from the top surface of a pillar to the top surface of the figurine. The additional magnet stacked atop the figurine thereby increases the magnetic attraction of that figurine. The physical principal behind this phenomenon involves the alignment of magnetic fields and the reduction of distance between magnetic poles. When a player stacks two or more magnets, the magnetic fields align and increase the overall magnetic power. Furthermore, when magnets are stacked as described, the distance between the magnetic poles of the magnets is reduced, resulting in a stronger combined magnetic field. Lastly, as players stack magnets atop a figurine, the overall height of the figurine increases. As players continue to stack magnets atop their figurine, they grow in magnetic B Field strength and overall height allowing a player to attract magnets from pillars of ascending heights.

Neodymium magnets are a type of rare-earth magnet made from an alloy of boron, iron, and neodymium (NdFeB). Neodymium magnets and other rare-earth magnets such as Samarium-Cobalt (SmCo), Alnico (Aluminum-Nickel-Cobalt), or Ferrite (Ceramic) are known for their strong magnetic fields relative to their size and pose a health risk if swallowed. Consequently, the United States Consumer Product Safety Commission (CPSC) has developed guidelines regarding the inclusion of rare-earth magnets in entertainment products, including board games, regardless of the age of the consumer. Document Part 1262—Safety Standards for Magnets (the entire content of which is incorporated by reference herein) aims to reduce or eliminate an unreasonable risk of death or injury to consumers who ingest one or more hazardous magnets from a subject magnet product. A hazardous magnet is one that fits entirely within the cylinder described in CPSC document 16 CFR 1501.4 (incorporated by reference herein), hereafter referred to as 'The Cylinder Test' (FIGS. 8*a* and 8*b*) and has a flux index of 50 $KG^2$ $mm^2$ or more when treated according to the method described in document 1262.4. To ensure the magnets used herein are in compliance with the guidelines, all magnets are permanently affixed in a magnet safety case (aka case) with overall dimensions greater than 31.7 mm in two dimensions, for example 34×34×2.5 mm as shown in FIGS. 9*a*-9*c*, to ensure each magnet passes The Cylinder Test.

In some embodiments, the presently disclosed subject matter is directed to a board game. The board game comprises a game board defined by a top surface upon which the game is played and a grid comprising an array of spaces. The game includes a plurality of pillars positioned on the top surface of the game board, each pillar comprising a predetermined height and a magnet releasably positioned on a top surface of the pillar, wherein the pillars have varying heights, and at least one pillar is configured as the tallest pillar. The game includes a plurality of figurines, each figurine comprising a magnet attached to a top surface of the figurine, wherein each figurine is configured to move about the grid. Each figurine has a first magnetic attraction that is sufficient to attract the magnet from atop pillars with a first height but insufficient to attract the magnets from the pillars with a second height that is greater than the first height. As each figurine attracts the magnets from atop the pillars, the first magnetic attraction is increased and the height of the figurine is increased relative to the number of magnets associated with each figurine.

In some embodiments, each pillar magnet is positioned within a magnet safety case on the top surface of each pillar. The pillar magnet and associated case are configured to relocate from the top surface of the pillar to the top surface of a figurine when a threshold magnetic attraction within a Zone of Magnetic Acquisition between the pillar magnet and figurine magnet is achieved. The term "Zone of Magnetic Acquisition" hereby defines the range of magnetic B Field strength (μT) around a figurine with a magnet on top that is sufficient to successfully attract the magnet from the top of a pillar to the top of the figurine.

In some embodiments, each case comprises a central indentation sized and shaped to house a pillar magnet.

In some embodiments, each case has a weight of about 0.25 grams.

In some embodiments, each pillar magnet is a neodymium magnet.

In some embodiments, the figurines have varying heights.

In some embodiments, the presently disclosed subject matter is directed to a board game. The board game comprises a game board defined by a top surface upon which the game is played and a grid comprising an array of spaces. The board game also includes a plurality of pillars positioned on the top surface of the game board, each pillar comprising a predetermined height and a magnet releasably positioned on a top surface of the pillar. The board game comprises a plurality of figurines, each figurine comprising a magnet attached to a top surface of the figurine, wherein each figurine is configured to move about the game board grid. Each figurine attracts magnets from pillars of different heights, based on the grade, size, and shape of the magnets and on a ferromagnetic composition of each figurine.

In some embodiments, each figurine comprises ferromagnetic metals or non-ferromagnetic substances to varying degrees such that the addition of magnets to each figurine results in a variety of magnetic B field strength as determined by magnetic induction.

In some embodiments, each case comprises a central indentation sized and shaped to house a pillar magnet with four or more projections that give the case greater than 31.7 mm of length in two dimensions so the case and magnet do not fit entirely within the cylinder used for The Cylinder Test as defined by the CPSC.

In some embodiments, each pillar magnet is positioned within a case on the top surface of each pillar, and wherein the pillar magnet and associated case are configured to relocate from the top surface of the pillar to the top surface of a figurine when a threshold magnetic attraction between the pillar magnet and figurine magnet is achieved.

In some embodiments, a figurine comprising a non-ferromagnetic stone requires a greater number of magnets to attract a pillar magnet from a pillar compared to a figurine comprising a ferromagnetic metal, which requires fewer magnets to attract a pillar magnet from a pillar as determined by magnetic induction.

In some embodiments, the non-ferromagnetic materials are selected from stone, glass, plexiglass, wood, plastic, ceramics, or combinations thereof.

In some embodiments, each pillar comprises non-ferromagnetic materials and each pillar magnet is of varying size, weight, and magnetic B field strength relative to other pillar magnets.

In some embodiments, the ferromagnetic materials include a ferromagnetic material or combination of materials are selected from iron or iron alloy.

In some embodiments, each pillar magnet is a rare-earth magnet comprising Neodymium-Iron-Boron (NdFeB), Samarium-Cobalt (SmCo), Alnico (Aluminum-Nickel-Cobalt), or Ferrite (Ceramic).

In some embodiments, each figurine has a weight of at least 8 grams.

In some embodiments, the presently disclosed subject matter is directed to a board game. The board game comprises a game board defined by a top surface upon which the game is played and a grid comprising an array of spaces. The board game includes a plurality of pillars positioned on the top surface of the game board, each pillar comprising a predetermined height and a magnet releasably positioned on a top surface of the pillar. The board game further comprises a plurality of figurines, each figurine comprising a magnet attached to a top surface of the figurine, wherein each figurine is configured to move about a game board grid. Each figurine attracts magnets from pillars of different heights, based on the composition and combined weight of each pillar magnet and case, as well as the composition of the pillar as determined by the degree of surface tension that exists between the pillar magnet and pillar.

In some embodiments, the board game includes a plurality of cases, each case configured to permanently house a magnet.

In some embodiments, each pillar magnet is positioned within a case on the top surface of each pillar, and wherein the pillar magnet and associated case are configured to relocate from the top surface of the pillar to the top surface of a figurine when a threshold magnetic attraction between the pillar magnet and figurine magnet is achieved.

In some embodiments, the degree of surface tension that exists between the pillar magnet and pillar is determined by the material used to construct the pillar and case, the shape of the pillar and magnet safety case, as well as the combined weight of the magnet and case.

BRIEF DESCRIPTION OF THE DRAWINGS

FIG. 8*a* is a top plan view of the cylinder. FIG. 8*b* is a cross-sectional view of the cylinder.

FIG. 9*b* is a top plan view, FIG. 9*c* is a front plan view, and FIG. 9*d* is a perspective view.

FIG. 10*a* illustrates a first figurine with overall dimensions of width 34 mm by length 34 mm with a height of 28 mm. FIG. 10*b* illustrates a second upgraded figurine overall dimensions of width 34 mm by length 34 mm with a height of 41 mm. Notably, the second figurine is about 1.5 times the height of the first figurine. Each figurine has a magnet fixed in a permanent fashion on top in accordance with some embodiments of the presently disclosed subject matter.

DETAILED DESCRIPTION OF THE INVENTION

Figure 1:
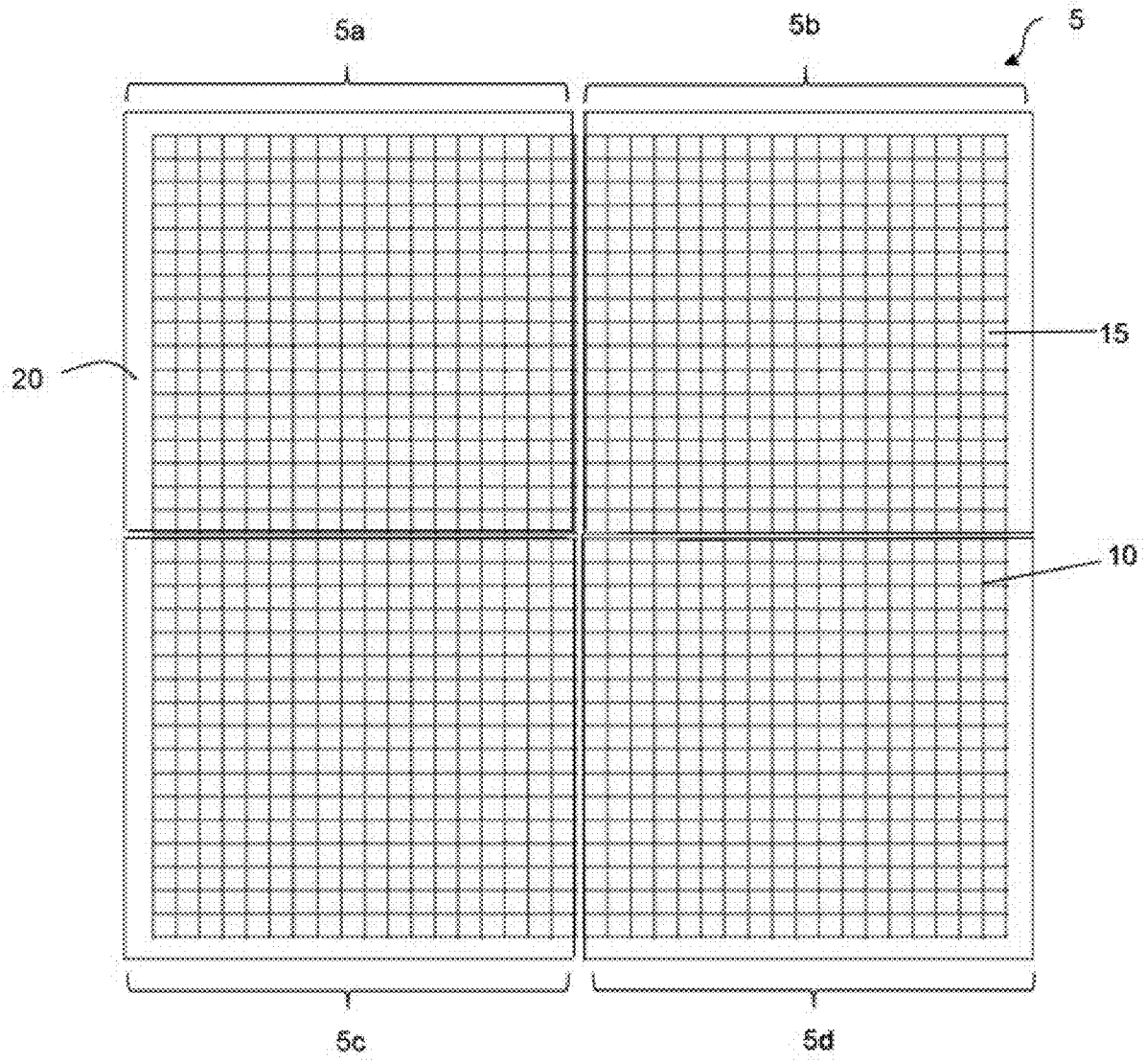
FIG. 1 is a top plan view of a game board showing four sections, a grid layout with numerous grid spaces surrounded by an outer perimeter in accordance with some embodiments of the presently disclosed subject matter.
Figure 2A:
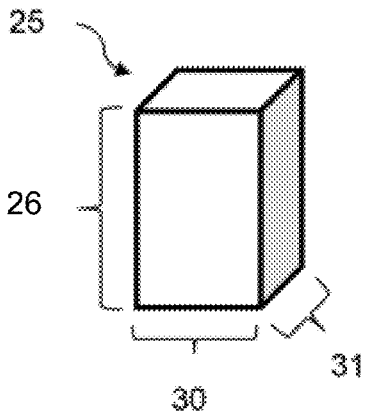
FIGS. 2*a*-2*d* are perspective views of game pillars of increasing heights in accordance with some embodiments of the presently disclosed subject matter.
Figure 2B:
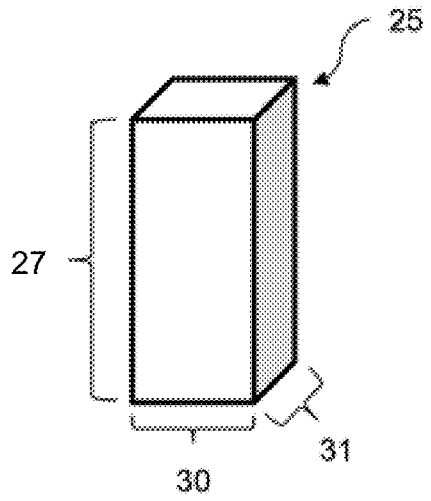
Figure 2C:
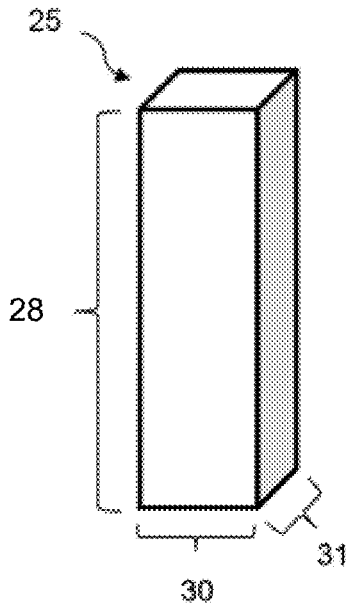
Figure 2D:
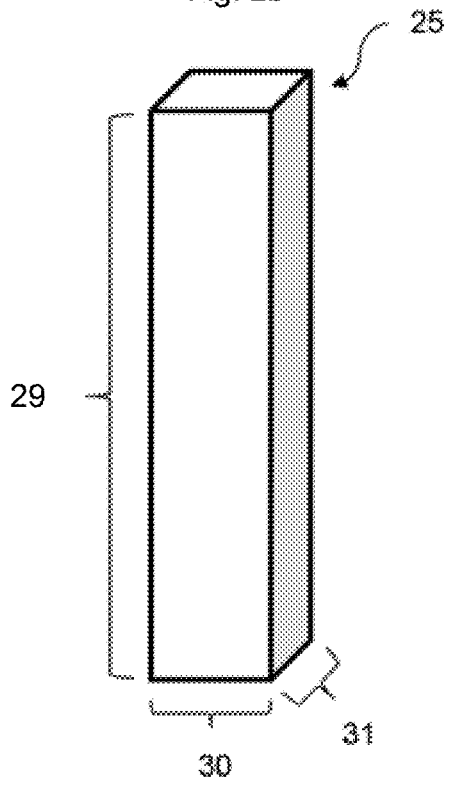

For the purpose of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skill in the art to which this disclosure belongs.

The presently disclosed subject matter is generally directed to a board game that includes the use of magnetic playing pieces. Specifically, the disclosed game comprises figurines that include one or more magnets. As the magnets are added or removed from the player's figurine, the amount of magnetic attraction associated with a particular figurine is increased or decreased, and the overall height of the figurine is also correspondingly increased or decreased. Each figurine is then used to attract magnets resting atop pillars of ascending heights positioned on the game board. The ability for a player figurine to attract a magnet from atop a pillar can be influenced by the height of the figurine and the pillar, the size, weight, and grade of the magnet, the size and weight of a magnet safety case that is permanently affixed to each magnet, as well as the composition of the pillar and case to influence the surface tension between the magnet and the pillar. The grade of a magnet refers to properties such as magnetic strength and resistance to demagnetization. Demagnetization refers to the loss or reduction of magnetization in a material, which can happen due to heat, external magnetic fields, vibration, and time. One objective of the game is to be the first player to attract the magnet from the tallest pillar, as described in detail below. However, it should be appreciated that there are numerous potential ways to play the game with many different rules suitable for defining game ending scenarios. The game further includes the use of cards, dice, monsters, and other challenging elements to increase player enjoyment.

FIG. 1 illustrates one embodiment of game board 5 upon which the disclosed game can be played. As shown, the board can comprise four sections 5*a*, 5*b*, 5*c*, and 5*d* that join together to form a unitary game board. Each section can be independently marked for identification with an image in each quadrant that only fits together one way to complete the full image, or each section could be marked with other more generic identifications (e.g., 1, 2, 3, and 4 or A, B, C, and D, etc.). In some embodiments, each section of the board makes up about 25 percent of the total surface area of board 5. However, the game board is not limited and can be constructed as a single unit, 2 units that cooperate to form a single board, 3 units that fit together, etc., and of various sizes with various total grid spaces to impact overall game length.

Board 5 includes an interior grid 10 comprising a plurality of horizontal and vertical lines that intersect to form an array of individual spaces 15 about which a player can move an assigned figurine, as discussed below. In some embodiments, the spaces are arranged in a series of consecutive squares as shown in FIG. 1, although any grid arrangement can be used. Each board section can include any desired number of spaces 15, such as about 100-1500 or more (e.g., at least about 100, 200, 300, 400, 500, 600, 700, 800, 900, 1000, 1100, 1200, 1300, 1400, or 1500 spaces). The spaces can be configured in any desired shape or size. For example, each space can have dimensions of about 15.875 mm×15.875 mm and be part of a 32×32 grid layout to form a board 5 that is 508 mm×508 mm. However, the presently disclosed subject matter is not limited.

Figure 11:
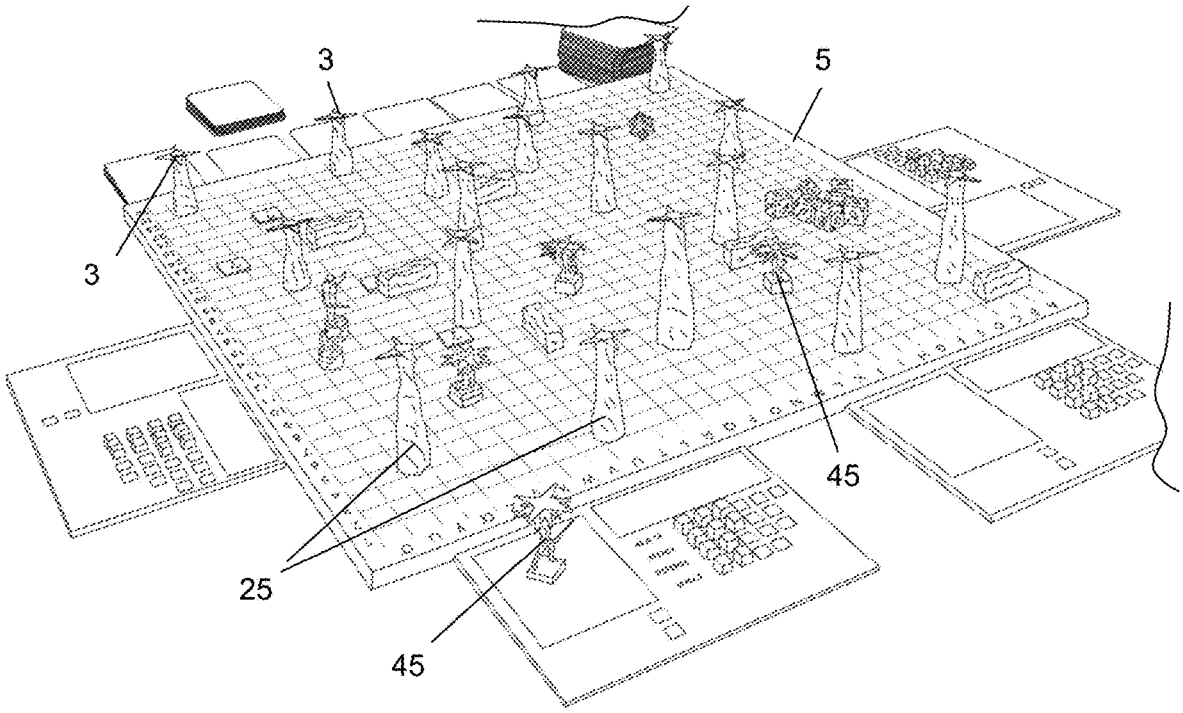
FIG. 11 is a perspective view of a playing board during initial setup. A playing board, pillars of ascending heights with magnets in magnet safety cases releasably positioned on top of pillars, figurines with magnets permanently affixed to their top surface, as well as other features that add to the entertainment value of the boardgame such as cards, walls, treasures, monsters, player boards, and dice are shown, in accordance with some embodiments of the presently disclosed subject matter.

Game board 5 further includes border 20 positioned about the exterior perimeter of the board, acting as a landing spot for players prior to entering the game and a zone for players to upgrade their starting figurine to the taller upgraded figurine, or respawn if their health is completely depleted. The border can be configured in any desired size and in some embodiments can include a grid system of letters or numbers, and/or can be highlighted using a different color or pattern compared to spaces 15. Furthermore, the border can include an alphabetic and numerical grid in the X and Y axes, respectively, that can facilitate placement of the pillars, walls, and treasures with a roll of dice (e.g. setup dice described below) to augment the novelty of each game played (FIG. 11).

Board 5 can be constructed from any suitable material, such as (but not limited to) cardboard, wood, plastic, ceramics, polymeric material, stone, metal, or combinations thereof. In some embodiments, the board can include a magnetic accepting surface to allow one or more items (e.g., a pillar as described below) to be retained at a set location on the board. A "magnetic accepting surface" refers to a surface upon which magnetic attractive forces retain the position of a cooperating item placed on the board (e.g., the location/position of the item is maintained due to the magnetic forces in the board). In some embodiments, each grid on the board includes a hole at the center used to securely place pillars and walls using a dowel system. The playing board, which can have a rigid or flexible body structure, is placed on a suitable playing surface for support (e.g., table or the floor).

The game also includes a plurality of pillars 25 of varying heights, as shown in FIGS. 2*a*-2*d*. For example, pillars can have length 30, width 31, and heights 26, 27, 28, and 29 where height 29 is greater than height 28 is greater than height 27 is greater than height 26. The term "length" refers to the longest horizontal distance of the pillar. The term "height" refers to the longest vertical distance of the pillar. The term "width" refers to the longest straight line distance between a front and rear face of the pillar. The pillar length, width, and height can be configured in any suitable dimensions. For example, each pillar can include width 31 and length 30 of about 12.7 mm (e.g., at least/no more than about 5.08, 7.62, 10.16, 12.7, 15.24, 17.78, 20.32, 22.86, or 25.4 mm). In some embodiments, each pillar can have a height that is greater than or equal to the length and width. For example, a pillar height can range from about 2.54-12.7 cm or more (e.g., at least about 2, 2.5, 3, 3.4, 4, 4.5, 5, 5.5, 6, 6.5, 7, 7.5, 8, 8.5, 9, 9.5, 10, 10.5, 11, 11.5, 12, 12.5, or 13 cm).

However, it should be appreciated that the number of pillars, unique heights of pillars, and dimensions of pillars 25 are not limited to the ranges given herein and can include any suitable number and various sizes as defined by length, width, and height. The pillars are designed so that there are short (FIG. 2*a*), medium (FIG. 2*b*), and tall pillars (FIG. 2*c*), as well as one tallest pillar (FIG. 2*d*) included in the game, with heights 26, 27, 28, and 29, respectively. In some embodiments, the height of the short pillar is determined so that a figurine with one magnet permanently affixed will be sufficiently powerful to attract a magnet sitting loosely atop the short pillar but will not be able to attract a magnet sitting loosely atop the medium pillar. Accordingly, each pillar of ascending height is designed so that additional magnets (i.e., typically 2 or 3 magnets) must be stacked atop the figurine to attract the magnet from the next highest pillar.

In some embodiments, each pillar includes a dowel on the bottom surface, allowing the pillar to be affixed within holes designated upon the top surface of board 5. However, any method of retaining pillars 25 on the game board can be used (e.g., magnets, clips, VELCRO®, magnetic tape, ties, adhesives, and the like). When magnets are used at the base of the pillar, they are configured to hold the pillars with sufficient force to keep the pillars in place on the board, but not with such force that gameplay is disrupted by interfering with magnetic forces associated with figurines or magnets being obtained from atop the pillars.

The game can include any desired number of pillars, such as about 5-25 or more (e.g., at least about 5, 10, 15, 20, or 25 pillars for a four-player game). It should be appreciated that the number of pillars 25 used varies depending on several factors, such as the size of the board, desired time it takes to play the game, and the number of players. For example, in some versions of the game, each player receives two 2.54 cm pillars, two 3.84-pillars, and one 5.08 cm pillars. In addition, a single 6.35 cm pillar can be placed on the board and holds the game winning magnet in some embodiments.

Although shown as rectangular or square in the figures, pillars 25 can be configured in any desired shape. It may be beneficial in some embodiments to include shapes with a flat top surface or a top surface with an outer ridge to securely hold magnets 35 in place with enough stability to not allow the magnet to accidentally fall from the pillar, but not with such force as to prevent the magnet from being attracted to a figurine with a magnetic field of appropriate strength that falls within The Zone of Magnetic Acquisition.

Figure 3A:
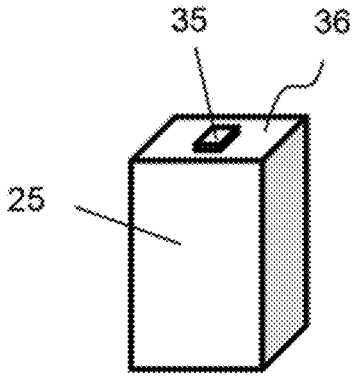
FIG. 3*a* is a perspective view of a game pillar with a pillar magnet releasably placed on the top surface in accordance with some embodiments of the presently disclosed subject matter.

Each pillar includes magnet 35 positioned on a top surface of the pillar, as shown in FIG. 3*a*. The magnet is non-affixed (e.g., not permanently retained on top surface 36 of the pillar). The term "magnet" refers to a body that produces a magnetic field. Any suitable magnet can be used, such as a neodymium bar magnet (provided by Min Ci, Shenzhen City, China) or other rare-earth magnets such as Samarium-Cobalt (SmCo), Alnico (Aluminum-Nickel-Cobalt), or Ferrite (Ceramic). A neodymium magnet is a permanent magnet constructed from an alloy of neodymium, iron, and boron to form the $Nd_2Fe_{14}B$ tetragonal crystalline structure. The strength of neodymium magnets is the result of the tetragonal crystal structure with exceptionally high uniaxial magneto-crystalline anisotropy (HA≈7 T–magnetic field strength H in units of A/m versus magnetic moment in $A \cdot m^2$). The neodymium atom can have a large magnetic dipole moment because it has 4 unpaired electrons in its electron structure as opposed to (on average) 3 in iron. In a magnet it is the unpaired electrons (aligned so that the spin is in the same direction on average) that generate the magnetic field. As a result, the neodymium magnet has a high saturation magnetization (Js≈1.6 T or 16 kG) and a remanent magnetization of typically 1.3 T. Therefore, as the maximum energy density is proportional to $Js^2$, this magnetic phase has the potential for storing large amounts of magnetic energy (BHmax≈512 $KJ/m^3$ or 64 MG·Oe).

Figure 3B:
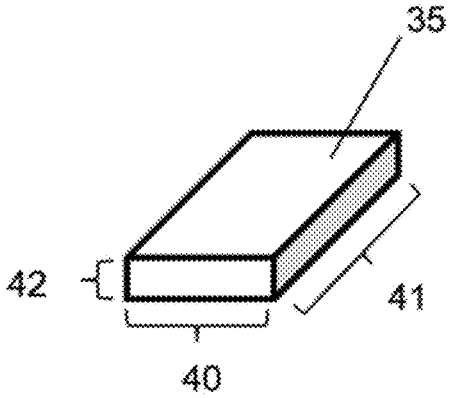
FIG. 3*b* is one embodiment of a rectangular pillar magnet with a height, width, and length in accordance with some embodiments of the presently disclosed subject matter.
Figure 9A:
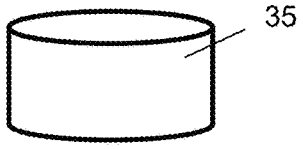
FIG. 9*a* is one embodiment of a cylindrical pillar neodymium magnet with dimensions of diameter of about 8 mm and height of about 2 mm in accordance with some embodiments of the presently disclosed subject matter.

Magnet 35 can have any desired shape and size. Thus, the magnet can be configured in a rectangular shape as shown in FIG. 3*b*, or the cylindrical shape shown in FIG. 9*a*, or any other shape such as square, triangular, hexagonal, etc. The magnet can also have rectangular dimensions with length 40, width 41, and height 42 of any desired dimensions, as shown in FIG. 3*b*. In some embodiments, magnet 35 can have a width 40 of about 2 mm, length 41 of about 3 mm, and height 42 of about 1.5 mm. In some embodiments, magnet 35 can be cylindrical and have a diameter and height of about 8 mm in diameter by 2 mm in height. However, it should be appreciated that the pillar magnet dimensions are not limited.

Figure 3C:
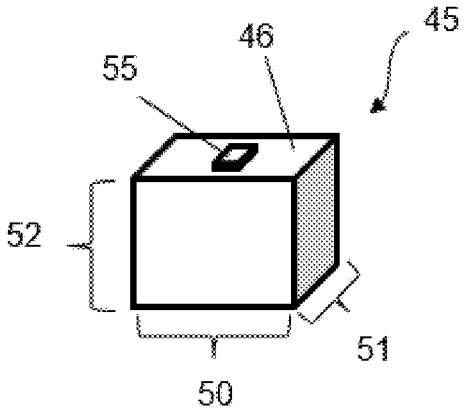
FIG. 3*c* is one embodiment of a game figurine with a width, length, and height, and a magnet fixed in a permanent or semi-permanent fashion on the top surface in accordance with some embodiments of the presently disclosed subject matter.

The disclosed game also includes a plurality of figurines 45, as illustrated in FIG. 3*c*. Each figurine can comprise magnetic accepting (ferromagnetic) or non-magnetic accepting materials (e.g., to attract or not attract a magnet). The term "ferromagnetic" refers to a material having large and positive susceptibility to an external magnetic field. Ferromagnetic materials have one or more unpaired electrons, so their atoms have a net magnetic moment. Ferromagnetic materials exhibit a strong attraction to magnetic fields and are able to retain their magnetic properties after the external field has been removed. Examples of ferromagnetic materials include, but are not limited to, iron, nickel, and cobalt. In some embodiments, figurine 45 can be constructed from stone or plastic (a non-ferromagnetic material). The term "non-ferromagnetic" refers to materials that are not ferromagnetic and are not sufficiently influenced by a magnetic field to attract or repel as effectively as ferromagnetic material. Suitable examples of non-ferromagnetic materials include (but are not limited to) wood, plastic, glass, plexiglass, ceramics, composite materials, and the like.

In other embodiments, figurine 45 can be constructed from ferromagnetic metal such as iron or alloys containing iron. Each figurine can include length 50, width 51, and height 52 of at least/no more than about 5.08 to 50 mm (e.g., at least/no more than about 5.08, 7.62, 10.16, 12.7, 15.24, 17.78, 20.32, 22.86, 25.4 or 50.8 mm). Each figurine can be configured to fit within one space 15 of the game board at the base. It should be appreciated that the dimensions of the figurines are not limited to the ranges given herein.

Each figurine 45 includes one or more magnets 55 positioned on top surface 46. In some embodiments, the magnet is permanently affixed to the figurine using any conventional mechanism, such as adhesive, welding, and the like (e.g., embodiments where the figurine is stone or plastic). In embodiments where the figurine is a ferromagnetic metal, the single magnet will naturally adhere to the top of the figurine through magnetic forces. Any suitable magnet can be used, such as (but not limited to) a neodymium magnet. It should be appreciated that figurine magnet 55 can be permanently affixed to the figurine to ensure that the magnet remains on the top face of the figurine.

In some embodiments, each figurine has a weight of at least 8 grams (e.g., at least/no more than about 8, 9, 10, 11, 12, 13, 14, or 15 grams). It should be appreciated that the weight of each figurine must be sufficient to prevent magnets 55 on two adjacent figurines from repelling or attracting one another in such a way that disrupts game flow. For example, a 12.7 by 12.7 by 12.7 mm wood cube weighing less than 1 gram with three magnets 55 positioned on a top surface will either repel or attract another nearby figurine with a similar dimension, weight, and magnetic strength, thereby making the gameplay unstable. Figurines of sufficient weight (e.g. greater than 8 g) remain fixed in their respective spaces 15 even when in close proximity, thereby ensuring smooth game play. It should be appreciated, however, that if two figurines 45 have sufficient magnetic strength they will attract or repel one another if moved into adjacent positions and serves as an example of how magnetism yields a unique and fun playing experience.

Figure 4A:
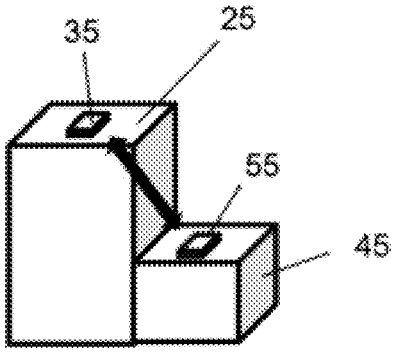
FIGS. 4*a* and 4*b* illustrate one embodiment of a pillar magnet releasably positioned on the pillar top surface being attained by a figurine with a magnet fixed in a permanent or semi-permanent fashion in accordance with some embodiments of the presently disclosed subject matter.
Figure 4B:
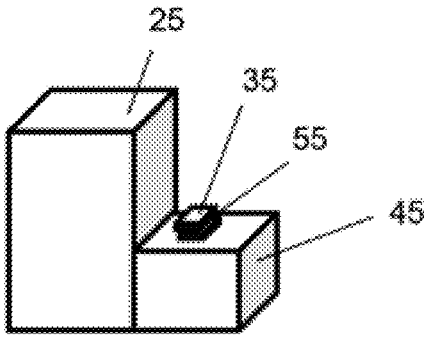

The disclosed game is calibrated such that a starting figurine 45 with a single magnet 55 affixed thereon has enough magnetic force (μT) to attract magnet 35 from the shortest pillar 25 configured at a first height when the figurine and pillar are in close proximity, as shown in FIGS. 4*a* and 4*b*. In response to the magnetic force associated with figurine magnet 55, pillar magnet 35 (FIG. 4*a*) can be transferred to the top face of the figurine (FIG. 4*b*), thereby strengthening the magnetic attraction of the figurine.

Figure 4C:
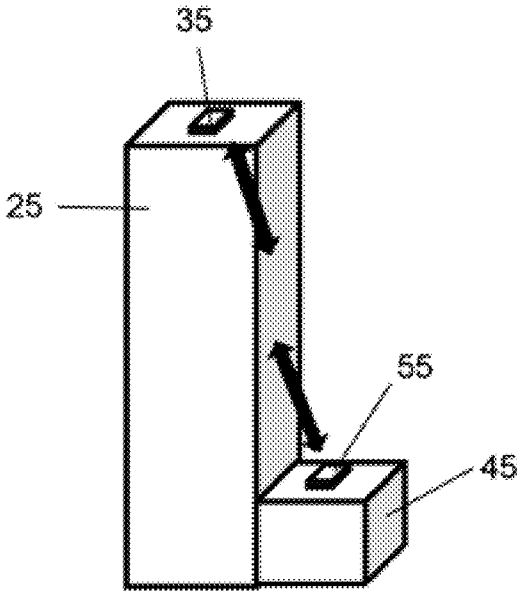
FIGS. 4*c* and 4*d* illustrate one embodiment of a pillar magnet under insufficient magnetic force to be attracted by a figurine with a magnet fixed in a permanent or semi-permanent fashion in accordance with some embodiments of the presently disclosed subject matter.
Figure 4D:
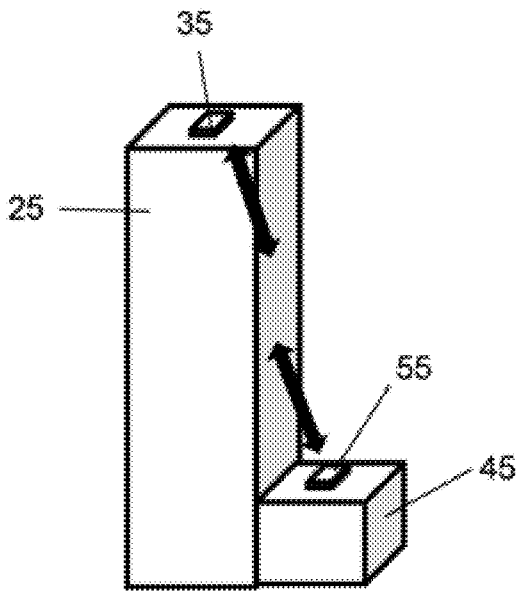

However, the game was also calibrated such that a starting figurine 45 with a single magnet had insufficient magnetic power to attract the pillar magnet on a taller pillar configured at a second height, as shown in FIGS. 4*c* and 4*d*. Thus, when figurine 45 is positioned adjacent to a pillar, if the attraction between figurine magnet 55 is enough to attract pillar magnet 35, the pillar magnet will then move to the top surface of the figurine, increasing the magnetic strength of the figurine magnet. This range of μT between figurines and pillar magnets where magnets may jump to figurine is defined as the Zone of Magnetic Acquisition. Through such combination of magnetic B Field forces achieved through acquiring additional magnets on a player's figurine, as well as the subsequent increase in figurine height as additional magnets are stacked on top, the figurine will eventually become sufficiently magnetically powerful and tall to acquire magnets from the taller pillars.

Magnetic fields are mathematically represented as vectors, which encode the intensity, the direction, and the point of application of the force field they represent. Two different vectors are commonly used to represent a magnetic field. The first, referred to as magnetic flux density or magnetic induction is symbolized by B. The other is referred to as magnetic field strength or magnetic field intensity is symbolized by H. The magnetic H field therefore is the magnetic field produced by the flow of current in wires, while magnetic B field is the total magnetic field including the contribution made by the magnetic properties of the materials in the field.

The following describes the calibration of the game wherein one skilled in the art will be able to reproduce the results in a way sufficient to replicate the game mechanics requiring magnetism as it pertains to the goal of acquiring magnets 35 atop a player figurine 45 to grow the figurines magnetic B field strength to allow magnets to be attracted from pillars of ascending heights as described in FIGS. 2*a*-2*d* above. Magnetic fields of figurines with magnets on top were measured using IPhone13 Magnetometer and App called 'Physics Toolbox (Physics Toolbox developed by Vieyra Software) in microTesla units (μT). Magnetometer was always positioned so top left corner rested on pillar top surface. Figurine 45 was placed directly adjacent to the wood pillar and below the top left corner of the magnetometer. Figurine was made of non-ferromagnetic stone and measured 12.7 mm×12.7 mm×12.7 mm with a neodymium magnet 35 with a width 40 of 2 mm, length 41 of 3 mm, and height 42 of 1.5 mm permanently attached to the top of the figurine with glue (e.g., cyanoacrylate).

Figure 5A:
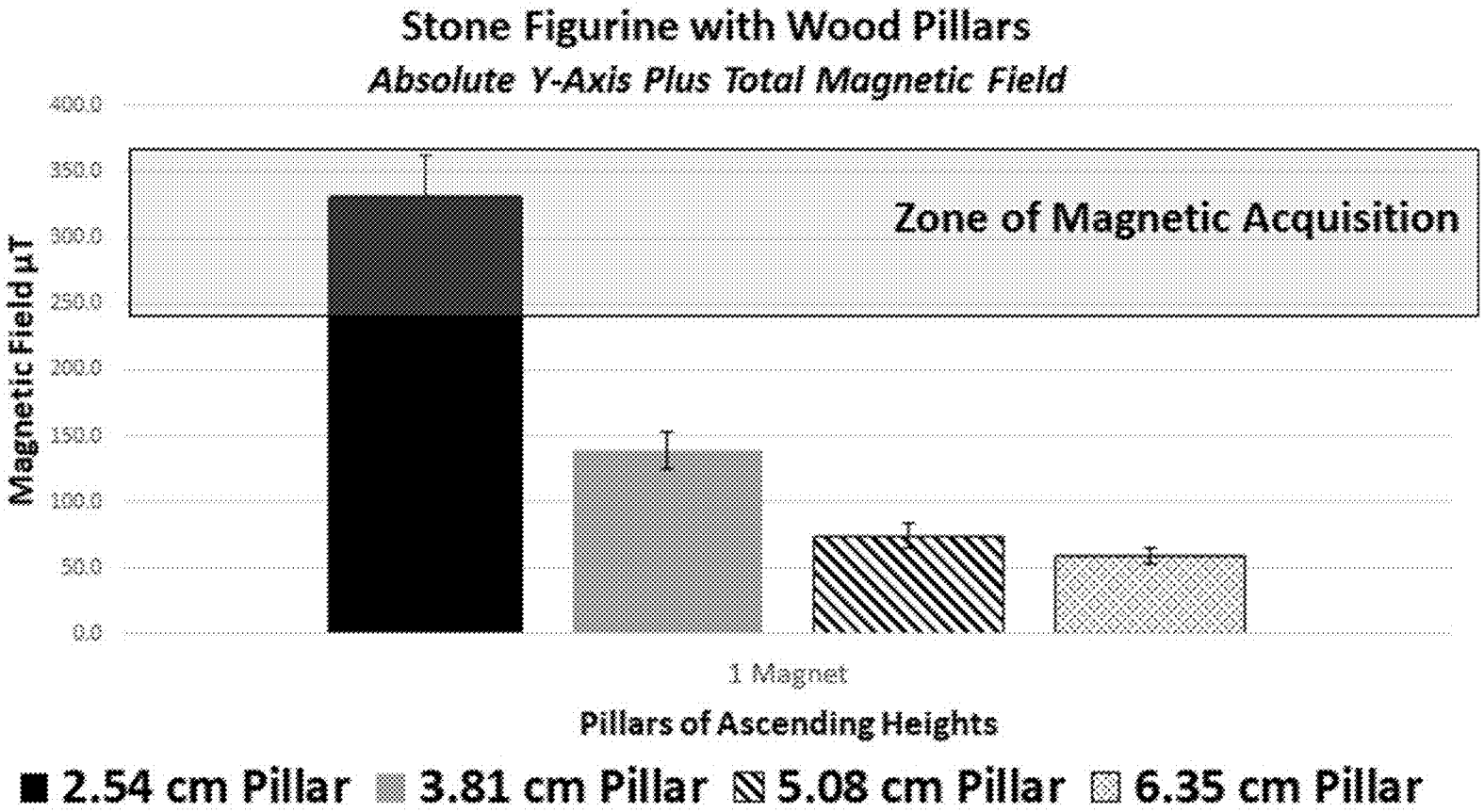
FIG. 5*a* is a bar graph illustrating the Magnetic Field (μT) between a stone figurine and wood pillars of varying heights from 2.54 cm (black bar), 3.81 cm (gray bar), 5.08 cm (striped bar), to 6.35 cm (dotted bar), each figurine comprising one neodymium magnet with dimensions of width of about 2 mm, length of about 3 mm, and height of about 1.5 mm permanently fixed to its top surface in accordance with some embodiments of the presently disclosed subject matter. The term "Zone of Magnetic Acquisition" defines the range of magnetic B Field strength around a figurine with a magnet on top that is sufficient to successfully attract the magnet from the top of a pillar.

FIG. 5*a* is a bar graph illustrating the combined Y-axis and total magnetic force (μT) between the stone figurine 45 with affixed magnet 55 on its top surface and top of wood pillars with heights of 2.54 cm, 3.81 cm, 5.08 cm, and 6.35 cm. As shown, the total magnetic force between the figurine and the top of the 2.54 cm pillar (black bar) is approximately 330 μT and is sufficient to attract pillar magnet 35 from the top face of the 2.54 cm pillar as the magnetic strength falls within the Zone of Magnetic Acquisition. In addition, the combined Y-axis and total magnetic force between the figurine and a pillar with a height of 3.81 cm (gray bar), 5.08 cm (striped bar), and 6.35 cm (dotted bar) is approximately 145 μT, 80 μT, and 59 μT, respectively, all of which are insufficient to acquire the pillar magnet and beneath the Zone of Magnetic Acquisition. Specifically, the Zone of Magnetic Acquisition highlights the magnetic force range (approximately 240 μT to 365 μT in this example) needed to acquire magnet 35 from each pillar. Thus, a stone figurine with a single magnet 55 is capable of acquiring pillar magnet 35 from only the 2.54 cm pillar, but not the 3.81 cm, 5.08 cm, and 6.35 cm pillar. Additional magnets are required to be added to the figurine to generate a magnetic field strong enough to acquire a magnet from the medium (3.81 cm), tall (5.08 cm), or tallest (6.35 cm) pillar.

Figure 5B:
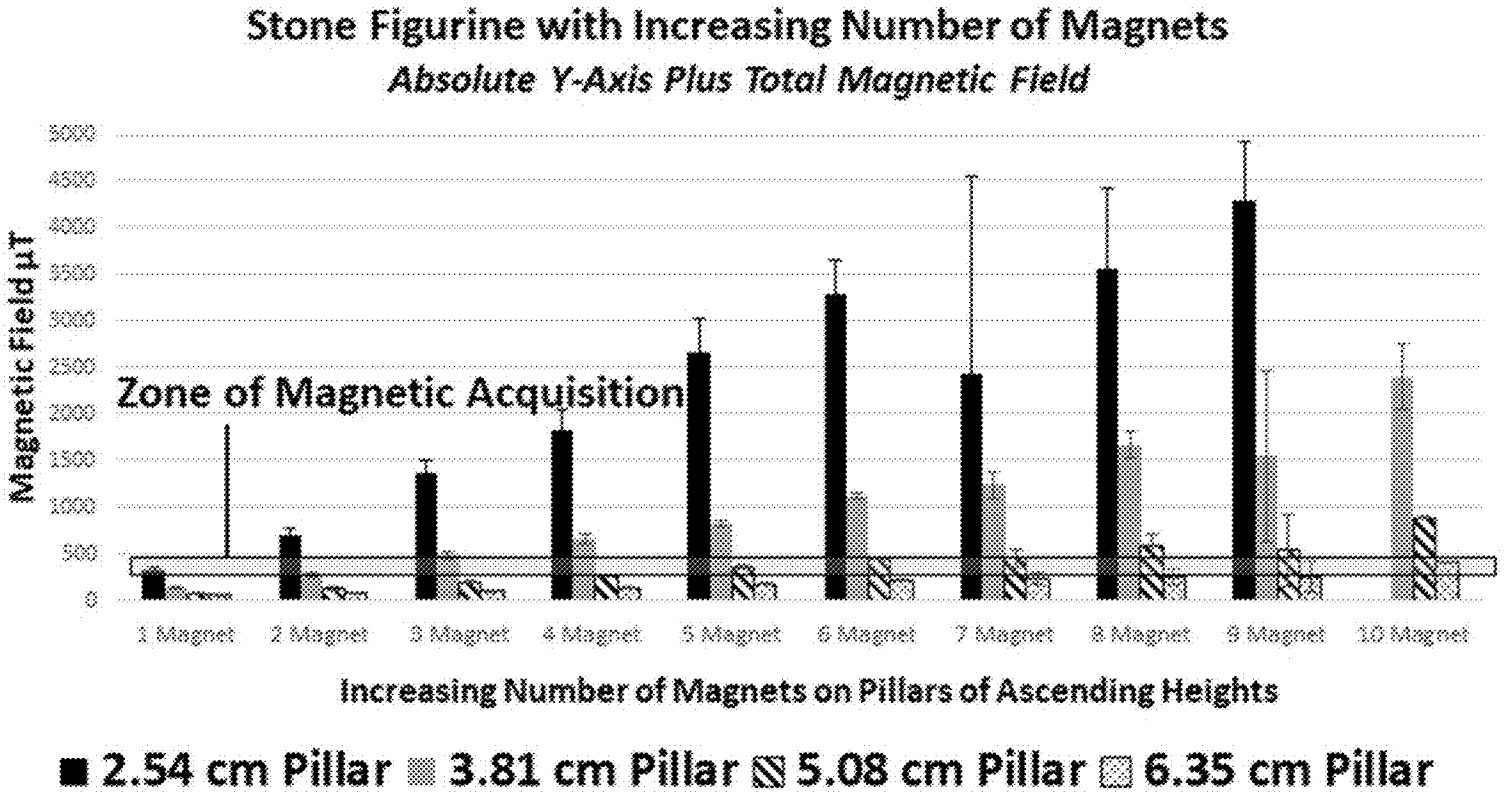
FIG. 5*b* is a bar graph illustrating the Magnetic Field (μT) generated between a stone figurine and wood pillars of varying heights as additional magnets (from 1 to 10) are stacked atop the figurine in accordance with some embodiments of the presently disclosed subject matter.

Using the same stone figurine adjacent to a wood pillar, the magnetic field was measured from the top of pillars of ascending heights as additional magnets 35 were stacked atop the figurine magnet 55 (FIG. 5*b*). Specifically, the magnetic field generated (Y-axis, μT) between a stone figurine and the tops of pillars with height of 2.54 cm, 3.81 cm, 5.08 cm, and 6.35 cm was measured. Each figurine includes 1-10 magnets (X-axis) on a top surface. As shown from the top of the 2.54 cm pillar (black bars), the increase in magnetic force of a figurine when 1-10 magnets are acquired ranges from 330 UT to over 4000 μT as measured using a magnetometer (described above). In contrast, from the tallest 6.35 cm pillar (dotted bar), the increase in magnetic force ranged from only 60 μT to 400 μT as you increase from 1 to 10 magnets. Importantly, the Zone of Magnetic Acquisition ranges from 240 UT to 365 μT and indicates the magnetic B Field strength needed to attract magnet 35 from atop each pillar of increasing height. FIG. 5*b* shows that one magnet 55 is needed atop figurine 35 to reach the Zone of Magnetic Acquisition and attract magnet 35 from atop the 2.54 cm pillar. Two magnets atop figurine 35 falls at the bottom of the Zone of Magnetic Acquisition for the 3.81 cm pillar (gray bar), whereas three magnets exceed the Zone of Magnetic Acquisition and will always lead to attraction of magnet 35 from atop the 3.81 cm pillar. Five magnets are needed atop figurine 35 to reach the middle of the Zone of Magnetic Acquisition for the 5.08 cm pillar (striped bar). Lastly, about 10 magnets on a top face of the figurine are needed to acquire magnet 35 from the tallest 6.35 cm pillar (dotted bar). As demonstrated here, as more magnets are acquired by each figurine, the magnetic force increases due to the summation of each magnet's B Field, essentially acting with force equal to a larger magnet of size equal to the combined individual magnets. Figurines also grow in overall height as more magnets are acquired. Thus, as the overall magnetic force and height grow, a figurine is eventually able to attract pillar magnet 35 from pillars of greater height.

Figure 6A:
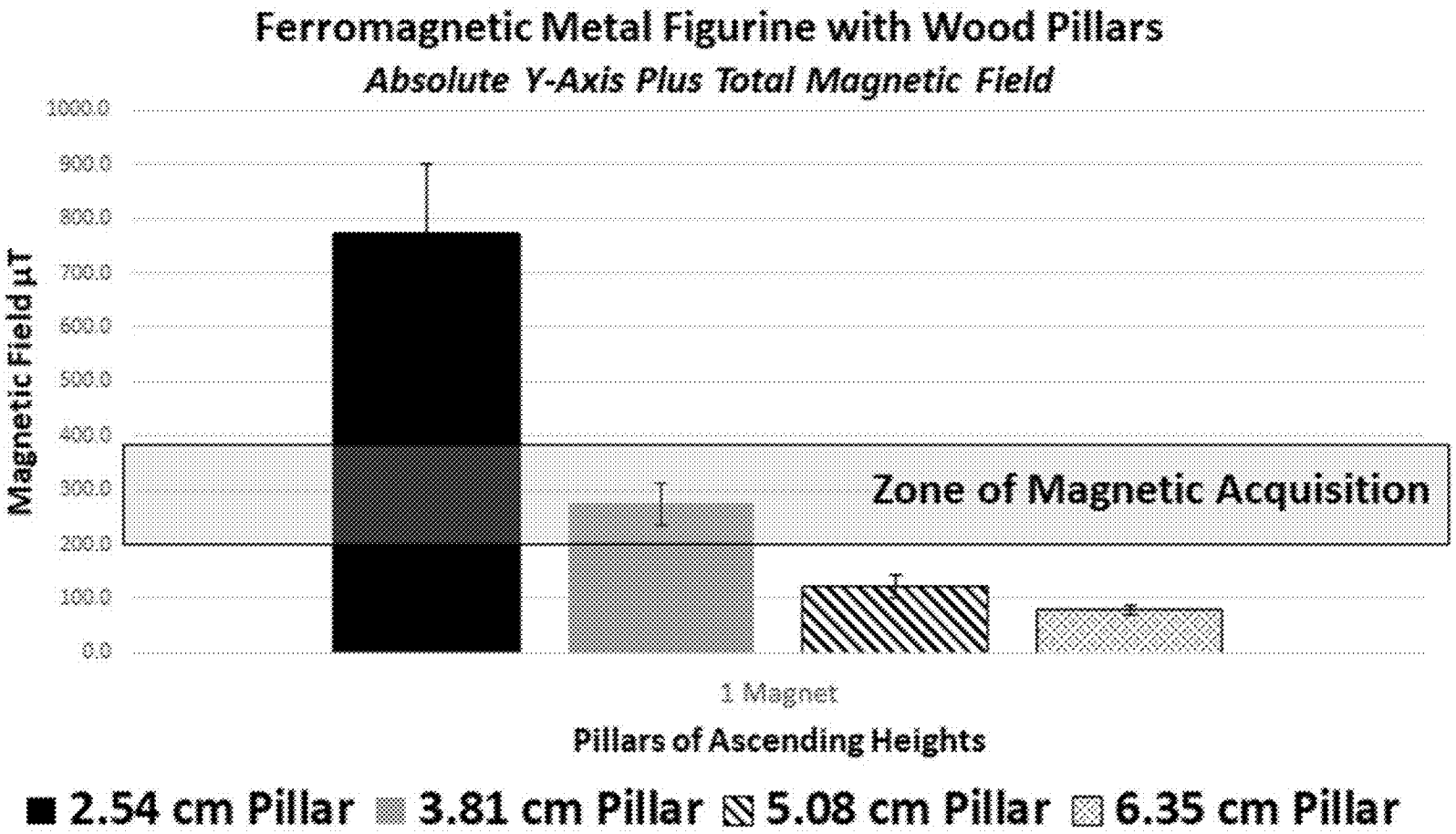
FIG. 6*a* is a bar graph illustrating the impact of Magnetic Induction when altering the ferromagnetic composition of figurines from non-ferromagnetic stone to ferromagnetic metal, such as steel alloy.
Figure 6B:
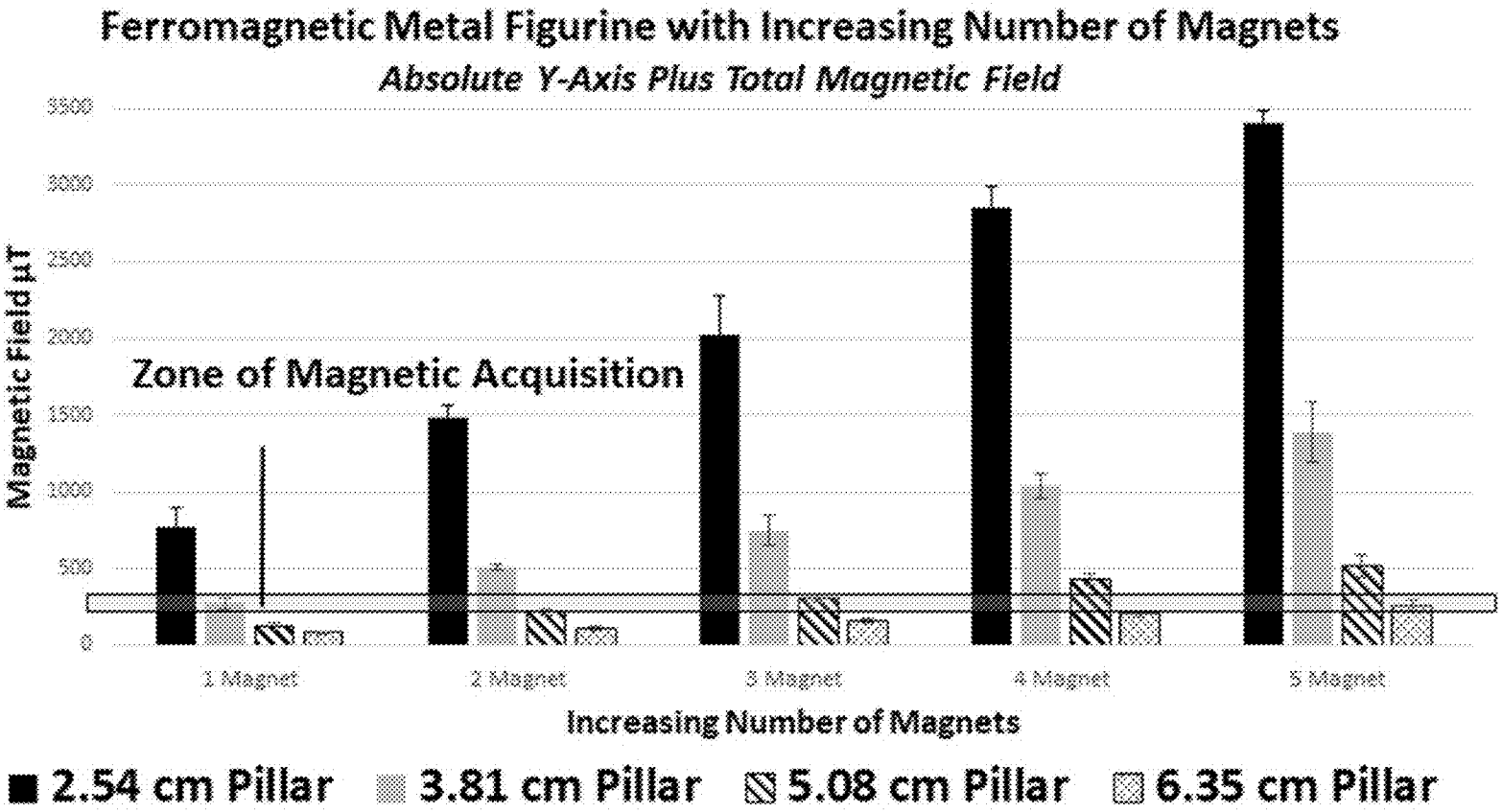
FIG. 6*b* is a bar graph illustrating the Magnetic Field (μT) generated between a ferromagnetic steel alloy figurine and wood pillars of varying heights as additional magnets (from 1 to 5) are stacked atop the figurine where the Zone of Magnetic Acquisition is achieved with fewer magnets in accordance with some embodiments of the presently disclosed subject matter.

In addition, the composition of each figurine 45 impacts the overall magnetic field generated by one or more game magnets. FIG. 6*a* depicts the impact of using a figurine composed of ferromagnetic material, such as a steel alloy, with a neodymium magnet 35 with a width 40 of 2 mm, length 41 of 3 mm, and height 42 of 1.5 mm semi-permanently attached to the top surface of the figurine through natural magnetic attraction. While the ferromagnetic figurine has similar overall dimensions as the stone figurine used in FIG. 5*a*, the magnetic field measured from atop the 2.54 cm (black bar), 3.81 cm (gray bar), 5.08 cm (striped bar), to 6.35 cm (dotted bar) wood pillars was 772, 274, 123, and 80 μT, respectively, compared to 330, 138, 74, and 59 μT, respectively, when using a stone non-ferromagnetic figurine as in FIG. 5*a*. There is consequently a shift in the Zone of Magnetic Acquisition where a ferromagnetic figurine with a single magnet 55 is able to attract magnets from atop the 2.54 cm as well as the 3.81 cm pillar, whereas the stone figurine with a single magnet 55 can only attract a magnet from the 2.54 cm pillar (as described above). This greater magnetic B Field strength of a magnet when in contact with a ferromagnetic material is due to the physical property called Magnetic Induction, whereby the magnet affects the ferromagnetic metal of the figurine in such a way as to confer magnetic properties to the metal which acts combinatorically with the magnet to increase the overall magnetic field. FIG. 6*b* illustrates far fewer magnets on a ferromagnetic metal figurine are needed to attract magnets from pillars of ascending heights with only 5 magnets needed atop the ferromagnetic Figurine to capture the magnet from the tallest 6.35 cm pillar (dotted bar).

Figure 7:
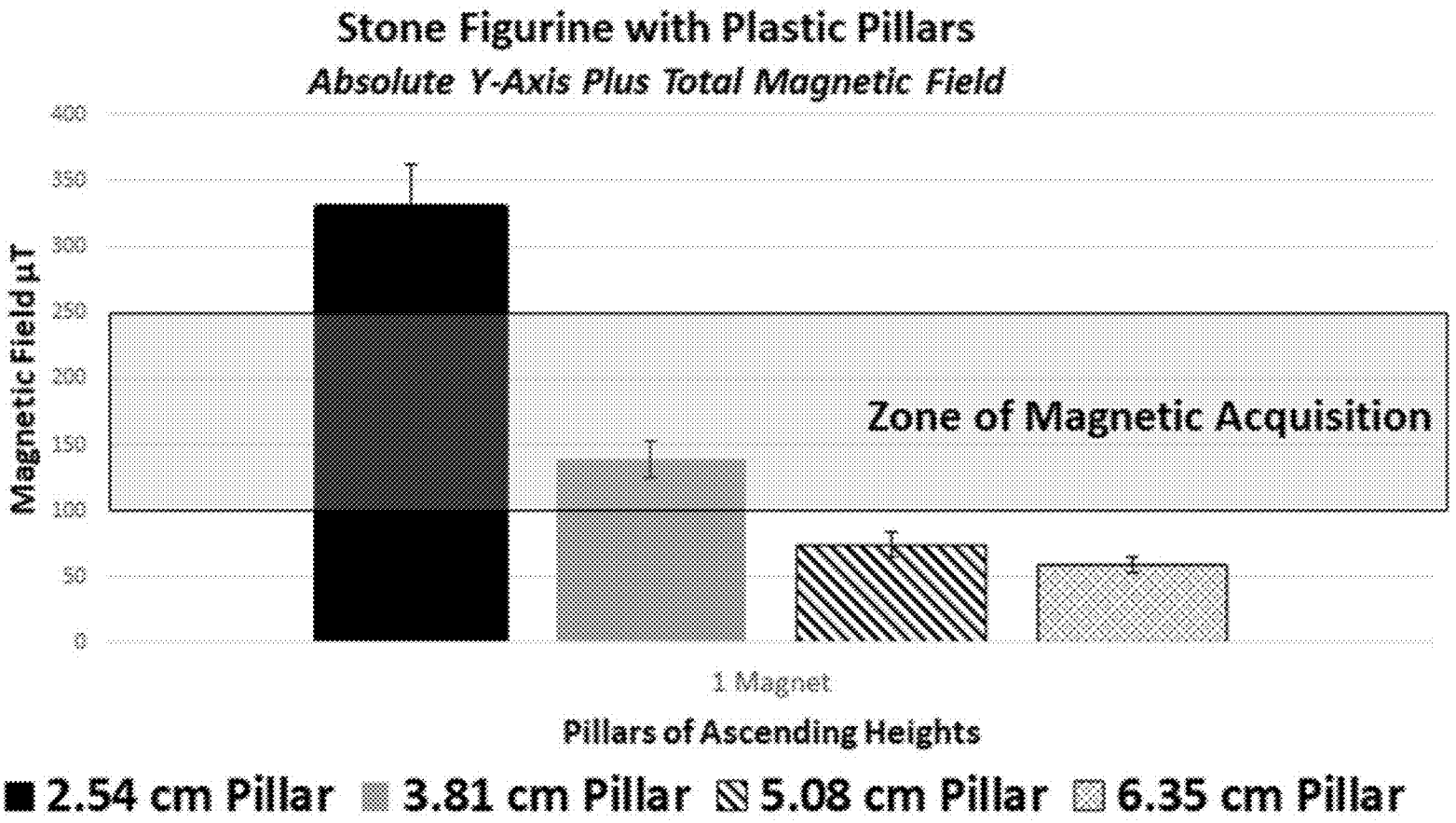
FIG. 7 is a bar graph illustrating the impact of reducing surface tension between a pillar magnet and pillars of various heights by replacing the course wood surface of the pillar with a smooth plastic.

FIG. 7 is a bar graph illustrating the impact of surface tension and frictional forces on the Zone of Magnetic Acquisition. "Surface tension" refers to a force acting opposite to the relative motion of an object, moving with respect to another object (also called "drag"). An increased surface tension tends to decrease velocity of the object in motion. For example, a pillar magnet with a smooth bottom surface will have a lower surface tension compared to a magnet with a rough or textured surface. Similarly, heavier magnets sitting atop a surface will create a greater surface tension compared to lighter magnets. Specifically, when pillar magnet 35 is positioned on a wooden pillar (FIG. 5*a*), the surface tension and corresponding frictional forces result in the Zone of Magnetic Acquisition ranging from 240 μT to 365 μT as described above. However, when the pillar magnet is positioned on a pillar constructed from smooth polymeric material (i.e. plastic), the surface tension and corresponding frictional forces are reduced, shifting the Zone of Magnetic Acquisition down to 105 μT to 250 μT, allowing a stone figurine 45 with a single magnet 55 to acquire pillar magnet 35 from the 2.54 cm (black bar) and 3.81 cm (gray bar) plastic pillars (FIG. 7) rather than just the 2.54 cm (black bar) wooden pillar (FIG. 5*a*).

It should also be appreciated that the movement and/or orientation of a figurine with affixed magnets 55 relative to the position of a pillar magnet unaffixed atop a pillar 35 can impact the strength of the overall magnetic field. Specifically, it has been determined that rotating the figurine and/or moving the figurine from one side to another side of a pillar may cause the pillar magnet 35 to suddenly be attracted to the figurine as long as the strength of the magnetic attraction lies within the Zone of Magnetic Acquisition. This uncertainty about exactly when a magnet may jump to a figurine contributes to the uniqueness and increased entertainment when utilizing magnetic forces within a boardgame.

Figure 8A:
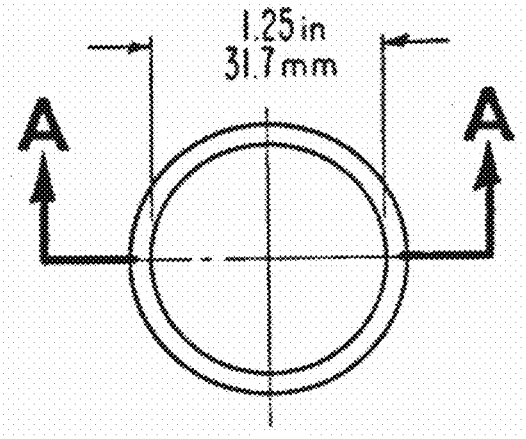
FIGS. 8*a* and 8*b* show the dimensions of the cylinder from The Cylinder Test as described in CPSC document 16 CFR 1501.4, incorporated by reference herein in its entirety. Specifically.
Figure 8B:
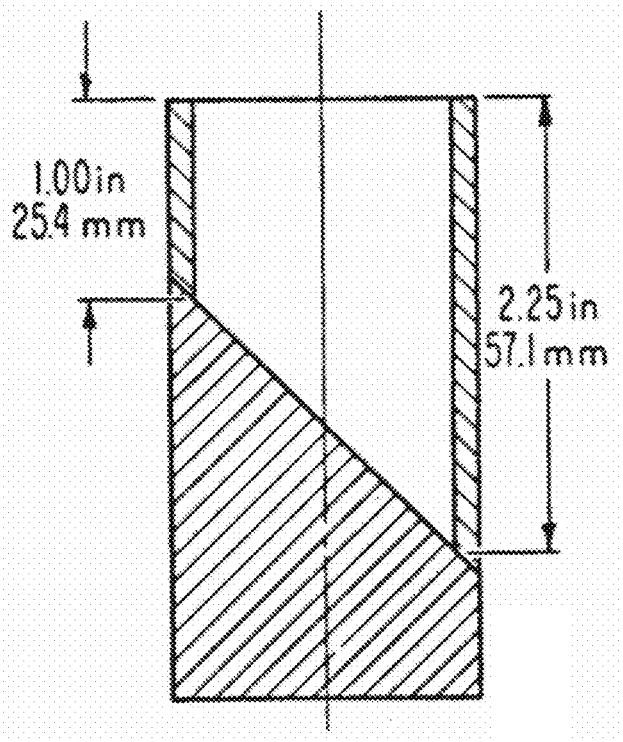

As mentioned above, the United States Consumer Product Safety Commission (CPSC) has developed guidelines regarding the inclusion of rare-earth magnets in entertainment products. The CPSC found as described in Document Part 1262—Safety Standards for Magnets (the entire content of which is incorporated by reference herein) that there were an estimated 26,600 magnet ingestions that led to treatments in hospitals from 2010 to 2021. Health risks due to magnet ingestion are serious and result from two or more magnets or a magnet and a ferromagnetic material attracting one another across the intestinal wall leading to numerous adverse gastrointestinal side effects. The CPSC developed guidelines that include The Cylinder Test which must be passed in order to include neodymium magnets in entertainment products. The Cylinder Test uses a cylinder with a diameter of 31.7 mm and a sloping depth from 25.4 mm to 57.1 mm (FIGS. 8*a* and 8*b*). If a magnet or an object containing a magnet fits entirely within the cylinder, then it will fail the test. Therefore, all magnets must be permanently affixed in a structure with overall dimensions of greater than 31.7 mm in two dimensions, to ensure each magnet will not fit into the cylinder and will therefore pass The Cylinder Test.

Figure 9B:
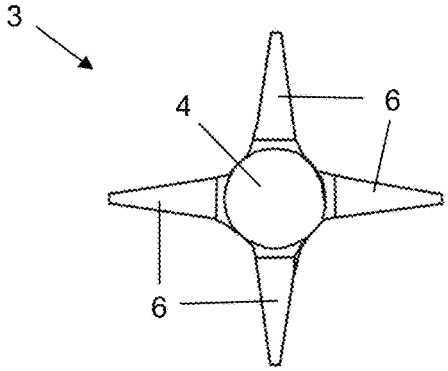
FIG. 9*b*-9*d* illustrate one embodiment of a magnet safety case that holds a permanently affixed cylindrical magnet to ensure that the magnet has overall dimensions that allow passage of The Cylinder Test. Specifically, the case is configured to hold a neodymium magnet with a cylindrical shape 8 mm in diameter and 2 mm in height within a central indentation and has four or more projections to achieve 34 mm of length in two dimensions.
Figure 9C:
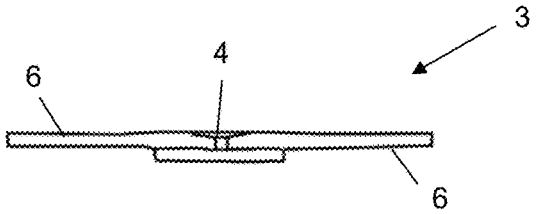
Figure 9D:
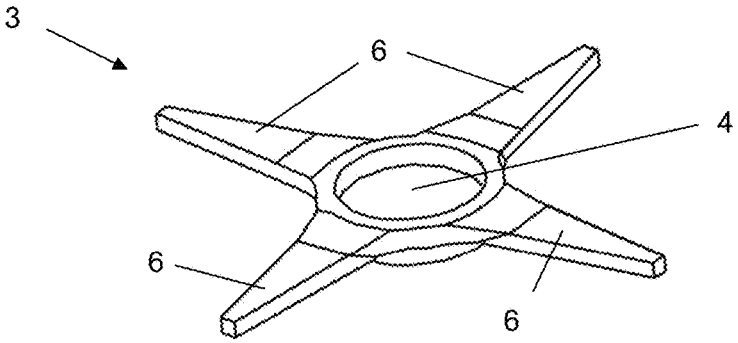

To meet the CPSC guidelines for use of neodymium magnets in an entertainment product, magnet safety cases were developed (FIGS. 9*a*-9*d*). In some embodiments, case 3 is configured to hold a magnet with a cylindrical shape 8 mm in diameter and 2 mm in height (FIG. 9*a*) within a central indentation 4 (FIG. 9*b*). The case further includes four or more projections 6 to achieve 34 mm of length in two dimensions, which prevents the magnet and case from being able to fit fully inside the cylinder used for The Cylinder Test. The case weighs about 0.25 g and is sufficiently light as to not impede the magnet from moving from atop the pillar to a nearby figurine (assuming said figurine has sufficient magnetic strength). In use, the case (comprising magnet 35) is positioned on a top surface of each figurine 45 and a top surface of each pillar 25. As a figurine moves across the board, when it approaches a pillar and has sufficient magnetic strength, case 3 and the associated magnet 35 are repositioned from the top face of a pillar to the top face of the figurine, as shown in FIG. 4*b*. More than one case and associated magnet can be positioned on the top face of the figurine. Alternatively, when a figurine approaches a pillar with insufficient magnetic strength, the case and magnet remain on the top surface of the pillar, as illustrated in FIG. 4*d*.

Figure 10A:
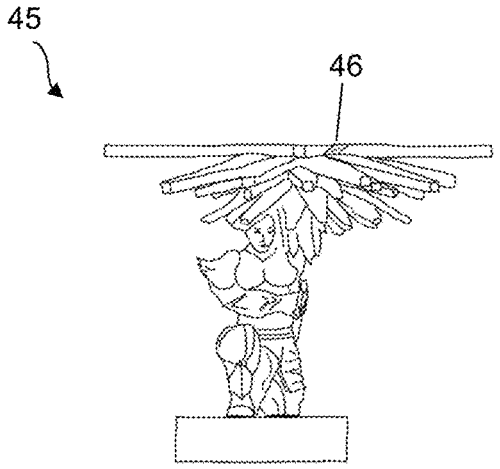
FIGS. 10*a* and 10*b* illustrate two game figurines.
Figure 10B:
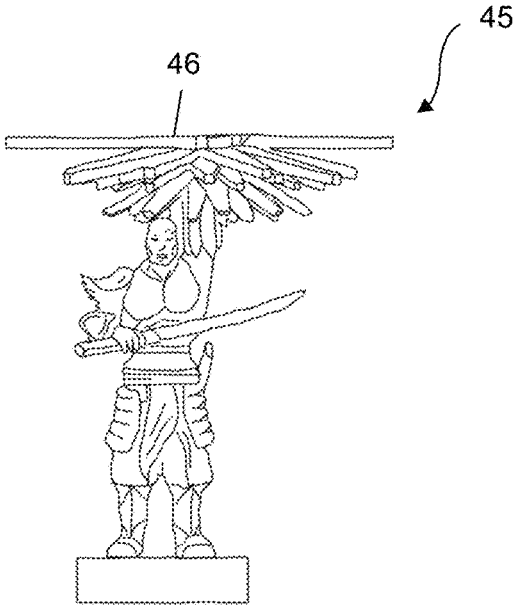

Figurines that contain a magnet must also be designed with appropriate dimensions to pass The Cylinder Test as described above. When figurines are constructed from ferromagnetic material, magnets can be encased permanently in a magnet safety case 3 as described above and shown in FIGS. 9*a*-9*d*. However, when figurines are made of non-ferromagnetic material (e.g. plastic), the magnet must be permanently affixed, and the figurine must have dimensions to allow passage of The Cylinder Test. For example, a first figurine can have overall dimensions of width 34 mm by length 34 mm with a height of 28 mm, as illustrated in FIG. 10*a*. Further, a second upgraded figurine can have overall dimensions of width 34 mm by length 34 mm with a height of 41 mm, as illustrated in FIG. 10*b*.

The following description will explain the rules of the disclosed game in general terms. However, it should be understood that the rules may be modified as desired. To play the disclosed game, board 5 is arranged so that the grid is complete and a plurality of spaces 15 are available for game play, as shown in FIG. 1 and FIG. 11. In some embodiments, pillars 25 of various heights are matched with a number in the grid that corresponds with their specific designation (e.g. marked by numbers 1, 2, 3, 4 for small, medium, tall, and tallest pillars, respectively) so that the game is played in a predictable fashion as pillars are placed in the same position at the start of each game. However, the game also includes embodiments where each pillar can be placed in a non-predictable fashion at the start of each game by the players such that each game played is potentially unique with respect to the arrangements of pillars of various heights. Regardless of the manner chosen to place pillars on the board, a single pillar magnet 35 permanently affixed within a case FIGS. 9*a*-9*d* is then positioned on a top surface of each pillar 25, as illustrated in FIG. 11. In some embodiments, there is a single tallest pillar and the object of the game is to acquire the magnet from the top surface of this tallest pillar.

Each player selects a figurine 45 comprising figurine magnet 55 permanently or semi-permanently affixed to a top surface (e.g., a stone, plastic, or iron alloy figurine with a magnet on top). The game further includes character boards and a series of cards (e.g., character cards, search cards, spell cards, and monster cards), as described below. In one embodiment, each player selects a character card for reference, and places on their character board three health cubes, three attack cubes, two defense cubes, and two wall spell cubes. Each player also begins with experience tokens worth 15 experience points (XP). A search deck is shuffled and stacked next to the playing board 5. Spell cards are shuffled, and five spell cards are turned over and revealed to all players and can be acquired by a player who exchanges the specified XP as shown on the spell card.

When ready to start the game and after pillars are placed, a game of chance determines the first player. For example, three dice can be rolled and the player with the highest sum of the movement symbols rolled goes first.

To start, a player may enter the board from game border 20. On each player's turn, they can perform the following 4 actions: 1) Move, 2) Search or Attack, 3) Cast a Spell, or 4) Learn a Spell. A player can also forego these 4 options and instead take the Meditation action to heal lost health units or the Dig action to remove a wall from the game board 5. Anytime a player acquires a magnet their turn ends immediately, and they may take no further actions. Accordingly, a player can move, learn a spell, cast a spell, and search or attack in any order they choose and must end their turn after completing a set of actions or anytime a magnet is acquired.

When a player opts to move, that player rolls three game dice and moves the number of spaces 15 on the board corresponding to the total number of pips shown on the three dice. Players may move their figurine in an up, down, left, or right direction via spaces 15 (i.e., players may not move diagonally). A player may rotate their figurine to try to adjust magnetic fields favorably in an attempt to attract a pillar magnet 35. Players move by sliding their figurine without lifting it from the playing surface of board 5. Lifting a figurine gives an unfair height advantage, which may result in the illegal acquisition of a magnet from atop a pillar.

For illustration of player movement, a player rolls three game dice for a total of 7 movement pips. The player moves four spaces, and their figurine is now adjacent to a pillar with a magnet on top. The pillar magnet moves but does not jump to the player's figurine. The player then moves three spaces around the sides of the pillar and the new orientation causes the pillar magnet to jump to player's figurine, ending the player's turn immediately (no further actions can be taken). In the example, if the player suspected they would acquire a pillar magnet, which ends their turn immediately, one strategy the player could take prior to their movement action that resulted in the acquisition of a pillar magnet 35 would be to attack or search, learn and/or cast a spell at the start of their turn.

When game play begins, each player is only powerful enough to attract pillar magnets 35 from the shortest pillars (e.g., 2.54 cm pillars in the examples above). A player may move past the taller pillars but will not obtain a corresponding pillar magnet from the taller pillars because their magnetic strength is well below the Zone of Magnetic Acquisition.

As a player obtains more pillar magnets (from pillars 25, the search deck, or from attacking other players), the player will become magnetically powerful and tall enough to attract pillar magnets from the taller pillars.

When a player obtains two pillar magnets in addition to the starting figurine magnet, the player can upgrade their first figurine to a taller upgraded figurine. To upgrade, a player may move to the outside border 20 and replace their short figurine with a taller figurine (e.g., from a crouching to a standing figurine as shown in FIGS. 10*a* and 10*b*). When a player upgrades to the taller figurine they are also granted several cubes that they can place on their character boards to increase their health, attack, and defense strength, as well as move one additional space on all movement rolls, and increase their spell casting range by two spaces (e.g. 6 to 8 spaces). The upgraded figurine can be configured roughly as 1.5 to 2 times the height of a starting figurine.

As magnets are added to each figurine 45, it must be appreciated that figurines cannot come too close to one another. In the event that one player makes a movement that causes their figurine to attract the figurine of another player and the figurines collide due to the attractive forces of their magnets, the infringing player gives one figurine magnet to the offended player. In addition, the infringing player is expelled from the board and may return to the game at their next turn by entering from the border 20. Alternatively, in the event that one player makes a movement that causes their figurines to repel an opponent such that the opponent figurine fall over on the board, the player may then move the fallen figurine up to 8 spaces away, an action that represents a magnetic push of the opponent.

In some embodiments, the game includes six 6-sided game dice that contain symbols on each side as: side 1=one pip and one skull; side 2=two pips, one shield, one energy blast; side 3=three pips and one energy blast; side 4=one pip, one shield, and one sword; side 5=two pips and one sword; side 6=three pips and one energy blast, where pips represent the number of spaces you may move your figurine, skulls represent a potential monster attack, swords represent a successful melee attack, energy blasts represent a successful ranged attack, and shields represent a successful block of melee or ranged attacks. It should be appreciated that the configuration above is one representative non-limiting example, and the disclosed game can have any of a wide variety of dice.

In addition to moving their figurine, a player may also choose to search or attack, learn a spell, or cast a spell. If the player searches, the player explores the space they land on by rolling a search die (described below).

If the player attacks, that player may attack another player or monster. An attack uses three dice unless the player has improved their attack strength throughout the game in which case they roll the number of dice according to the number of cubes on their attack attribute indicated on their character board.

For a melee attack, a player must be adjacent to a target player or monster. In some embodiments, diagonal players and monsters are also considered adjacent. Only sword symbols rolled count towards the attack.

For a ranged energy blast attack, a player with a starting figurine must be within 6 spaces of the target player or monster (diagonals count), or within 8 spaces once a player has an upgraded figurine. Only energy blast symbols rolled count towards the attack.

If a player attacks another target player and eliminates all of their health, the player takes half of that player's figurine magnets, gains 30 XP, and the target player is removed to the game border 20 with full health and may reenter the board on their next turn. The player that acquired the figurine magnets ends their turn immediately as is the case whenever a player acquires a magnet.

When a target player suffers a melee or ranged attack, that player can defend by rolling two dice unless the player has improved their defense strength throughout the game in which case they roll the number of dice according to the number of cubes on their defense attribute indicated on their character board.

If a player successfully defeats a monster, that player removes the monster from the board, can make another attack as a reward for the successful attack, and collects the XP points associated with defeating that particular monster.

A player can also expend XP to learn or cast a powerful spell. When using spells to attack another player, a player with a starting figurine must be within 6 spaces of the target player or monster to cast a spell (diagonals count), or within 8 spaces once a player has an upgraded figurine. To cast the spell, the player must have acquired the spell using the number of XP points indicated on the spell card and must expend the same amount of XP to cast the spell. A player can keep spells learned during the game but must expend XP for each use. When a player learns a spell, they select one of the spell cards that have been turned over next to the spell deck, which includes spells such as:

1) Resonant Strike—Upon casting, add 1 die to all attack rolls. All attack actions are enhanced.
2) Bio-Fortification—Add 1 die to all defense rolls. All defense actions are enhanced.
3) Mana Drain—CHOICE: Successfully casting this spell allows you to cancel all active spells OR take 40 XP from opponent.
4) Wall spell—Place 1 wall unit within spell casting range. The ground erupts into an impenetrable barrier.
5) Shadow Warrior—Congers a loyal apparition to fight alongside you until defeated.
6) Portal spell—Open a portal and move up to 8 spaces in any direction.
7) Steal Tochon Magnet—Successfully casting this spell allows you steal 1 Tochon Magnet from an opponent.
8) Levitation Spell—Upon casting, place your figurine on a Levitation Cube (about 5 mm extra height).
9) Magnetic Repulsion Spell—Successfully casting this spell allows you to move an opponent up to 8 spaces in any direction.
10) Thian Rolling Blitz—Successfully casting this spell causes all Thian monsters on the board to drop into ball form and roll 8 spaces towards opponent.
11) Invisibility Cloak—You cannot be attacked and monsters move towards the next closest opponent.
12) Dulled Blade—Subtract 1 die from all attack rolls. You deal extreme damage to your opponent's attack capabilities.
13) Broken Shield—Subtract 1 die from all defense rolls. You cripple your opponent's defenses.
14) Altered Reality—Casting this spell allows you to reroll any number of dice on a movement OR attack OR defense action.

Monsters can sometimes appear when a player rolls three dice as part of their movement action. For example, one side of each game die includes a Thian skull and when two skulls are rolled, an Ankylocat monster appears and immediately attacks the player. If three skulls are rolled, a Thian monster appears and immediately attacks the player. No monster appears when a single skull is rolled.

Monsters can also appear during a search roll if a player rolls the Thian skull on the 20-sided search die. The player is then immediately attacked by a Thian monster.

Monsters can also be drawn from the search deck.

When a monster appears, it is always placed by the opponent sitting to the right of the player who stumbled upon the monster and positioned adjacent to that player's figurine. Ankylocat monsters must be adjacent to a player to attack as all attacks are melee attacks. Thian monsters can attack from up to three spaces away (ranged spell attack) or can also make a melee attack if adjacent to the player's figurine. Diagonal counts as adjacent.

Sword symbols on game dice count as a melee attack and energy blast symbols on game dice count as ranged attacks. For all monster attacks, an opponent rolls the number of attack dice as indicated on the monster card drawn (three dice for Ankylocat monsters and four dice for Thian monsters). The attacked player must roll to defend as described above. Only shield symbols count in a defense roll. When attacked by a player, monsters roll the number of defense dice as indicated on their card, one game die for Ankylocat monsters and two game dice for Thian monsters.

If a monster is not adjacent to a player, they move towards the closest player figurine (unless that player has used an Invisibility Cloak or is in the border zone 20). Ankylocat monsters can move up to five spaces while Thian monsters move 3 spaces and will move horizontally or diagonally on the shortest path to reach the closest player. In the case of the Ankylocat monster, if they move so they are adjacent to a player, they then attack. In the case of the Thian monster, if they move until adjacent to the closest player then they make a melee attack or if they are not adjacent after moving 3 spaces but are within three spaces of the player then they can make a ranged attack.

If no players are on the board (all have been wounded and have lost a figurine magnet and are in the border 20) then monster(s) move towards the tallest pillar.

To defeat a monster, a player must wound the monster the number of times equal to the hearts shown on the monster's card, once for an Ankylocat monster and three times for a Thian monster. Upon defeat, the player that defeats the Monster removes the monster figurine from the board, returns the monster card to the monster deck, and collects the XP reward (15 XP for an Ankylocat monster, 30 XP for a Thian monster). After defeating a monster, the player may make another attack. If no monster is defeated, then a player is only allowed one attack per turn.

Walls can be placed on board 5 and used to obstruct an opponent's movement or as defense against ranged attacks.

In some embodiments, the game comprises eight short pillars, eight medium height pillars, and four tall pillars, as well as one tallest pillar on the board for a 4-player game. However, it should be appreciated that the number of pillars can vary and are not limited to the range set forth above.

In some embodiments, the same pole of each magnet is placed facing upwards on each figurine so that figurines with magnets stacked on top will predictably repel one another when in close proximity.

In some embodiments, the poles of each magnet are randomly placed on each figurine with either the north or south pole facing upwards, so it is unknown whether figurines with acquired magnets will attract or repel one another when in close proximity.

In some embodiments, the game includes treasure tokens that are placed within various grid spaces on the board. Players can obtain the treasures to enhance their abilities and experience during game play.

In some embodiments, six 6-sided setup dice are rolled to determine the starting position of walls and treasures. Each setup die includes two grid coordinates on each face that correspond with the grid markings on the outer perimeter of the board and direct the placement of walls and treasures. In some configurations, the walls and treasures each have 36 potential locations, and rolling the six dice can result in 46,656 unique starting configurations, thereby adding to the uniqueness of each game played.

In some embodiments, rolling a search die grants a player one or more cards from a search deck. Each card grants the player skills, special moves, health, experience points (XP), or reveals monsters (that can be called Thians or Ankylocats) that the player must defend themselves against and ultimately defeat.

In some embodiments, the search die has 20 sides. In some embodiments, each side of the die includes an indication of an image that corresponds to an action the player must take. For example, the die image can include a magnifying glass (the player earns one search card), a magnifying glass with the number '2' (the player earns two search cards), an "M" (the player earns one search card after upgrading their starting figurine to the taller figurine, an image of a skull (a monster appears and attacks), or an image of an energy shield that results in no actions being taken when rolled as a search action, but counts as a successful block of an XP spell cast at a player. It should be appreciated that the die images can vary and are not limited to the images disclosed above.

The game includes a series of search cards:

1) Spiritual Gift-Obtain a Special Skill. Requires 3 additional Skill Cards OR only 2 additional Skill Cards if you select your Natural Ability
2) Enhanced Attack—Upgrade Attack +1. Requires 2 additional Skill Cards. You apply a Druidic Salve to your living sword.
3) Enhanced Defense—Upgrade Defense +1. Requires 2 additional Skill Cards. You apply a Druidic Salve to your living shield.
4) Tochon Magnet—Add Tochon to your Figurine. CHOICE: Requires 2 Tochon Cards OR 1 Tochon Card+4 Skill Cards. You find a hidden Tochon.
5) Healing Flower—CHOICE: Upgrade Max Health +1 with 2 additional Skill Cards OR Heal 1 health unit.
6) Rejuvenating Meal—CHOICE: Upgrade Max Health +1 with 2 additional Skill Cards OR Heal 2 health units.
7) Combat Skill—Gain 10 XP. You learn a new fighting technique from a wandering Mage Warrior.
8) Herbalism Skill—Gain 15 XP. You find a rare herb used to make Druidic Salves.
9) Magic Skill—CHOICE: Gain 20 XP learning new spell casting technique OR Move 3 spaces.
10) Heroic Skill—CHOICE: Fight the wandering beast and Gain 30 XP, losing 1 health unit OR Run and Gain 10 XP.
11) Portal—Move up to 8 spaces in any direction.
12) Dehydration—Lose 1 health unit AND gain 20 XP. You have run out of water.
14) Stamina—You may use the Search and Attack action in the same turn.
15) Block XP Spell—Negate any XP spell cast upon you.
16) Perseverance—Acquiring a Tochon Magnet does not end your turn.
17) Earthquake—Place 2 wall units adjacent to 1 opponent.
18) Magical Bounty—CHOICE: Acquire a spell at a 15 XP discount OR Cast 2 spells in the same turn.
19) Obstruction—The player to your right places a wall unit anywhere adjacent to you. You have reached an impasse.
20) Shuffle Spell Deck-You may replace up to 3 spells from draw pile with new spells.
21) Counterattack—After a defense action you may immediately attack even when not your turn.
22) Monster Portal—If within Spell Casting Range, move an attacking monster up to 8 spaces in any direction.
23) Dig—Remove an adjacent wall or obstruction anytime during Movement action.
24) Scry—Look at the top 3 Spell Deck cards, rearrange their order and/or bury them at bottom of the deck.
25) Respawn Anywhere—If your health is depleted you can respawn from any alter on your next turn.
26) Second Chances—Reroll any number of dice from a Movement OR Attack OR Defense action.
27) Thian!—Draw a Thian card from the monster deck. He attacks you immediately.
28) Ankylocat!—Draw an Ankylocat card from the monster deck. She attacks you immediately.

In some embodiments, rolling a 10-sided alchemy die can result in a player being able to draw a search card even when it is not their turn if that player's assigned alchemy symbol (e.g. earth, magnet, iron, or steel) is rolled.

In some embodiments, the disclosed game can be played on a 3-dimensional board as disclosed herein. However, the presently disclosed subject matter can also be configured as a virtual game (e.g., a video game or associated mobile application) wherein the physical magnetic forces, heights of figurines and pillars, composition and surface tension of pillars and magnets, etc. are all simulated virtually.

What is claimed is:

1. A board game comprising: a game board defined by a top surface upon which the game is played and a grid comprising an array of spaces; a plurality of pillars positioned on the top surface of the game board, each pillar comprising a predetermined height and a pillar magnet releasably positioned on a top surface of the pillar, wherein the pillars have varying heights, and at least one pillar is configured as the tallest pillar; a plurality of figurines, each figurine comprising a figurine magnet attached to a top surface of the figurine, wherein each figurine is configured to move about the grid; wherein each figurine has a first magnetic attraction that is sufficient to attract the pillar magnets from atop pillars with a first height but insufficient to attract the pillar magnets from the pillars with a second height that is greater than the first height; wherein as each figurine attracts the pillar magnets from atop the pillars, the first magnetic attraction is increased and the height of the figurine is increased relative to the number of magnets associated with each figurine.

2. The board game of claim 1, wherein each pillar magnet is positioned within a case on the top surface of each pillar, and wherein the pillar magnet and associated case are configured to relocate from the top surface of the pillar to the top surface of a figurine when a threshold magnetic attraction within a Zone of Magnetic Acquisition between the pillar magnet and figurine magnet is achieved.

3. The board game of claim 2, wherein each case comprises a central indentation sized and shaped to house the pillar magnet with four or more projections that give the case greater than 31.7 mm of length in two dimensions so the case and magnet do not fit entirely within the cylinder used for The Cylinder Test as defined by the Consumer Product Safety Commission (CPSC) described in 16 CFR 1501.4, last amended 1 Apr. 2026.

4. The board game of claim 2, wherein each case has a weight of about 0.25 grams.

5. The board game of claim 1, wherein each pillar magnet is a rare-earth magnet comprising Neodymium-Iron-Boron (NdFeB), Samarium-Cobalt (SmCo), Alnico (Aluminum-Nickel-Cobalt), or Ferrite (Ceramic).

6. The board game of claim 1, wherein the figurines have varying heights.

7. A board game comprising: a game board defined by a top surface upon which the game is played and a grid comprising an array of spaces; a plurality of pillars positioned on the top surface of the game board, each pillar comprising a predetermined height and a pillar magnet releasably positioned on a top surface of the pillar; a plurality of figurines, each figurine comprising a figurine magnet attached to a top surface of the figurine, wherein each figurine is configured to move about the game board grid;

wherein each figurine attracts magnets from pillars of different heights, based on the a grade, size, and shape of the pillar magnets and on a ferromagnetic composition of each figurine.

8. The board game of claim 7, wherein the ferromagnetic composition each figurine comprises ferromagnetic metals or non-ferromagnetic substances to varying degrees such that an addition of pillar magnets to the figurine results in a variety of magnetic B field strength as determined by magnetic induction.

9. The board game of claim 7, wherein each pillar magnet is positioned within a case on the top surface of each pillar, and wherein the pillar magnet and associated case are configured to relocate from the top surface of the pillar to the top surface of a figurine when a threshold magnetic attraction between the pillar magnet and figurine magnet is achieved.

10. The board game of claim 8, wherein the figurine comprising a non-ferromagnetic substance requires a greater number of attracted magnets to further attract a pillar magnet from a pillar compared to a figurine comprising a ferromagnetic metal, which requires fewer attracted magnets to further attract a pillar magnet from a pillar as determined by magnetic induction.

11. The board game of claim 8, wherein the non-ferromagnetic substances are selected from stone, glass, plexiglass, wood, plastic, ceramics, or combinations thereof.

12. The board game of claim 7, wherein each pillar comprises non-ferromagnetic materials and each pillar magnet is of varying size, weight, and magnetic B field strength.

13. The board game of claim 7, wherein each figurine has a weight of at least 8 grams.

14. A board game comprising: a game board defined by a top surface upon which the game is played and a grid comprising an array of spaces; a plurality of pillars positioned on the top surface of the game board, each pillar comprising a predetermined height and a pillar magnet, wherein each pillar magnet is positioned within a case releasably positioned on a top surface of the pillar; a plurality of figurines, each figurine comprising a figurine magnet attached to a top surface of the figurine, wherein each figurine is configured to move about a game board grid; wherein each figurine attracts pillar magnets from pillars of different heights, based on the composition and combined weight of each pillar magnet and case, as well as the composition of the pillar as determined by a degree of surface tension that exists between the pillar magnet and pillar.

15. The board game of claim 14, further comprising a plurality of cases, each case configured to permanently house the pillar magnet.

16. The board game of claim 14, wherein each pillar magnet is positioned within the case on the top surface of each pillar, and wherein the pillar magnet and case are configured to relocate from the top surface of the pillar to the top surface of the figurine when a threshold magnetic attraction between the pillar magnet and figurine magnet is achieved.

17. The board game of claim 14, wherein the degree of surface tension that exists between the pillar magnet and pillar is determined by the material used to construct the pillar and case, the shape of the pillar and case, as well as the combined weight of the magnet and case.

* * * * *